US006028566A

United States Patent [19]

Pennell et al.

[11] Patent Number: 6,028,566

[45] Date of Patent: Feb. 22, 2000

[54] OMNI-DIRECTIONAL PLATFORM

[75] Inventors: Mark C. Pennell, San Antonio; Ray D. Ullrich, Austin, both of Tex.

[73] Assignee: Omniform, Inc., Austin, Tex.

[21] Appl. No.: 09/136,082

[22] Filed: Aug. 16, 1998

[51] Int. Cl.[7] ..... H01Q 1/12; H01Q 9/34; A47B 96/06; E04C 3/30

[52] U.S. Cl. ..... 343/878; 248/219.3; 52/726.4; 52/736.2; 343/874; 343/879

[58] Field of Search ..... 343/878, 879, 343/874, 875, 891, 890; 52/726.3, 726.4, 736.2, 40; 248/219.3, 121

[56] References Cited

U.S. PATENT DOCUMENTS 5,440,319 8/1995 Raymond et al. ..... 343/833
5,467,955 11/1995 Beyersmith ..... 248/219.3

*Primary Examiner*—Hoanganh Le
*Assistant Examiner*—Jennifer H. Malos
*Attorney, Agent, or Firm*—Royston, Rayzor, Vickery, Novak & Druce, L.L.P.

[57] ABSTRACT

A personnel platform assembly and antenna support assembly for wireless communication transmitting and receiving devices such as antennas used in at least cellular telephone networks. The support assembly includes a support frame connectable upon an aerial tower which is adapted for supporting wireless communication transmitting and receiving devices thereupon. A connecting assembly is provided for fixing the support assembly at an above-ground elevation upon the aerial tower and a guide rail is suspended at a distance about the connecting assembly or central column of the tower. The guide rail is adapted for accepting a coupling to the wireless communication transmitting or receiving device and the coupling is continuously positionable along a length of the guide rail for accommodating variable positioning of the wireless communication transmitting or receiving device about the aerial tower. Suspension arms are connected as part of the connecting assembly between the guide rail and tower or its extension for suspending the guide rail thereabout. A plurality of substantially upright posts may be connected upon the guide rail at a lower end of each of the upright posts and each of the plurality of posts then be connected to a hand rail distally from the lower end. At least one optional floor deck panel establishes a platform for supporting installation and service personnel. The coupling is adapted to pivot about a substantially horizontal axis for accommodating down-tilt of a wireless communication transmitting or receiving device supported thereupon and the coupling is adapted for sliding movement along the guide rail thereby accommodating continuous operation of a wireless communication transmitting or receiving device during a repositioning procedure thereof.

15 Claims, 5 Drawing Sheets

OMNI-DIRECTIONAL PLATFORM

INDUSTRIAL APPLICABILITY

The present invention finds applicability in the wireless communication industries, and more specifically in the design and construction of aerial towers upon which transmission and receiving antennae are mounted.

BACKGROUND ART

In today's highly mobile society, wireless communications have become increasingly prevalent and important for both personal and business uses. These wireless communications include paging services and other transmissions of data at least partially over wireless communication systems. Most widely recognized in this field, however, is the use of wireless telephones for voice communication.

Focusing specifically on voice communications, and what are commonly referred to as cellular telephones, there is no hard wired connection between the handset at the user location and the communication infrastructure. A radio signal is utilized for transmission over at least the wireless communication paths between the user hand piece and a receiving and transmitting device typically embodied in an elevated antenna. As will be well understood by those familiar with wireless communication systems' designs and implementations, aerial towers are dispersed about the landscape and conversations are "handed-off" between adjacent "cells" as a user travels a path across one or more coverage areas. The construction and configuration of individual towers varies based on local requirements. Antennas may be located upon existing buildings or topographically elevated sites, or they may be elevated upon an aerial tower similar to those used for the elevation of other utilities. In the instance of individual aerial towers, it is not unusual for their height to run from as little as forty feet to as much as five hundred or more feet.

Wireless communications, and particularly cellular voice service, is currently accommodated through the use of at least two varieties of antennae. Each is mountable upon the aerial towers previously described but have different operational and performance characteristics. Still further, antennae of various designs may be dictated by the mode of data communication such as analog and digital transmission.

One device used for transmitting and receiving these wireless transmissions is a panel antenna. These antennas are typically rectangularly box-shaped and generally, but not required to be configured to have widths between four and twenty inches, thicknesses between four and eight inches, and heights ranging between two and eight feet. These panel antennas are most often arranged in arrays that collectively are configured to cover generally pie-shaped areas that may extend over one hundred and twenty degree sectors. Individually, a panel antenna typically covers a tear-shaped or lily pad-shaped area. In use, these coverage areas, however, are normally altered or tailored by tilting and focusing the antenna downward and toward a specific service area.

Within each array is at least one transmit and one receive antenna. In the instance of analog transmissions, three sectors, each one hundred and twenty degrees in span, are utilized thereby requiring three antennas arrays to be appropriately configured to cover a three hundred and sixty degree zone about a tower's location. To accommodate the necessary three arrays of panels, the supporting platform and associated framework upon the aerial tower is typically three-sided or triangularly shaped.

This configuration can be contrasted with digital communications through panel antennas or antenna arrays which may span ninety degree coverage sectors thereby dictating the utilization of four panel antennas for full radial service about the tower. If four such panel arrays are utilized, the configuration of the support platform then changes from a triangular shape to a square shape for accommodating the four panels. When panel antennas are utilized, mobile phone calls are handed off between coverage zones as a user passes from one cell into another. There is normally a slight overlapping in the coverage zones so that uninterrupted conversation is made possible. The design of the panel antenna also facilitates high user densities, but in a relatively localized service area.

The second type of antenna is generally referred to as an omni-directional antenna and instead of being box shaped, the omni-directional antenna normally takes the form of an elongate cylinder. The visible exterior appearance of the omni-directional antenna is established by a sheathing which may be constructed from poly vinyl chloride pipe or similar elements. The actual transmit and receive antenna structures are contained within the sheathing; typically with transmit antennas pointed upward and receive antennas pointed downward. Each antenna has the capability to cover a three hundred and sixty degree circular service area.

As described above, a mobile telephone call is typically handed-off between panel antennas from one service area to the next based on travel path. The omni-directional antenna passes a call from one antenna to the next, instead of from one coverage area to the next. Therefore, the omni-directional antenna is typically aimed from one tower to another and these aimings may change on a frequent basis based on service requirements and new facility installations. The omni-directional antenna has a significantly greater capability for enlarged coverage areas over the panel antenna, but they are not as well suited to high user densities or traffic as is the panel antenna. Therefore, selection criteria between antenna design, as indicated above, is based at least in part on user densities and required coverage area. As a result, panel antennas are normally selected for urban uses or high traffic areas such as interstates, while omni-directional antennas are often used in rural settings where larger coverage areas are needed, but there are fewer users and less traffic in the service zone.

As addressed above, it is not uncommon for user requirements to dictate changes in antenna configurations on a regular basis. This creates discontinuous service situations and significant expense to the owner and administrator of the wireless system. Based on current designs, regardless of an antenna's type, it is fixedly mounted upon a platform structure of an aerial tower. Presently, pedestal-styled platforms are mounted upon a spindle column that is connected to the tower's upper end by mating bolted flanges. Antennas may also be supported individually or in groups on arm attachments to an elevating pole; but according to present designs, those arm are not positionally adjustable, but instead are fixed. The current method by which the orientation of a particular antenna is adjusted is to unbolt the mated flanges and rotate the entire platform to another boltable position wherein the uniformly spaced holes of the two flanges mate-up again. Obviously, this type of configuration prevents setting positions between such discrete and specifically defined boltable positions. In an effort to enhance this method for varying and adjusting the platform's position, the bolt holes of flanges of currently designed platforms have been slotted. These slots, however, are not continuous about the flange and therefore adjustability is compromised.

Of equal importance is the fact that each reconfiguration or reaiming of one or more antennas of a platform assembly becomes a substantial undertaking with respect to both man hours and required equipment. Typically, a crane will be necessary to support the platform while disconnected from tower's top flange. This requires a crew to be dispatched not only for the crane's operation, but also for the disconnection, rotation and reconnection of the platform itself. This demand for personnel and the associated expense is accentuated by the fact that this type of reconfiguration of the platform additionally requires the disconnection of the antenna, and consequently user service. This is a highly undesirable situation for the service provider since users are not able to use the network and no revenue is derivable during the reconfiguration time period. As a result, these procedures are often undertaken at night when user utilization is at its lowest, but personnel charges are most expensive.

Another aspect which must be dealt with in the design of an aerial tower for such purposes is the location and configuration of the associated shelter positioned adjacent to the base of the tower and within which the driving radio frequency equipment is housed for the wireless portions of the network. Normally, communication wiring is run from the antenna located atop the tower through the interior of the tower's pole or support column to a lower exit port through which the wiring passes to the shelter. A design criteria for this exit port and connection to the shelter is that it be as direct as possible without turns and angles. Based on the inflexibility of known systems, the position of the shelter is often dictated by the required orientation of the tower. As a result, the shelter is not always positionable in the most advantageous ground location proximate to the tower. Therefore, by accommodating continuous adjustability in the positioning of individual antennas atop the tower, restrictions in the design at the base of the tower will be removed.

In light of these highlighted and other deficiencies in present aerial tower designs for wireless communication antennas, the present invention has been developed in response thereto.

DISCLOSURE OF THE INVENTION

In the disclosed embodiment, the present invention alleviates the drawbacks described above with respect to the known designs for platforms upon which antennas are located for wireless communication reception and transmission. More specifically, through the use of a continuous rail upon which the antennas are directly mountable and continuously positionable, the need for reorientation of the entire platform is negated. When situations do arise requiring the repositioning of a specific antenna, service is no longer required to be discontinued, nor is a crane and repositioning crew required for reorientation of the entire platform. Instead, an individual technician can be dispatched who climbs to the top of the tower and individually slides or translates the antenna by its connection upon the continuous mounting or guide rail. No longer is a crane and its operator or crews for disengaging the mated flanges between the platform and tower's top required because the platform remains fixed to the tower unless exchange of the entire platform head-piece is required. By including the mated flange mounting design, however, the present invention is not only suitable as original equipment upon a new tower that includes such a flange design, but it is also advantageously suited as a retro-fit for existing tower facilities topped by a mateable flange. In yet another embodiment, the invention is adaptable to tall guyed towers.

Still further, by an alternative design of the platform of the present invention, the platform's mounting may be made at any point along the tower's or pole's length. Not only does this facilitate the connection of a greater number of antennas with variable positioning upon multiple guide rails at different levels on the tower or pole, but it also facilitates interconnection between adjacent guide rails for providing suitable connectivity for large antennas and other items requiring greater support than is possible from a single guide rail.

The tubular construction of the guide rail permits interconnection to the antenna's mounting that is generically accomplished by any friction-type clamp, and more specifically through the use of a U-shaped bolt that is easily configured for releasable engagement upon the rail. Use of such a friction clamp also facilitates translational sliding movement of the antenna along the guide rail's length. In this manner, continuously variable positioning is made possible through the platform's design according to the present invention. Still further, utilization of round shapes and tubular in the construction of various components of the platform reduces wind drag atop the tower and therefore increases load capacity for a particular tower's design.

As an enhancement to the platform's basic design, a hand rail may be also included above the platform's decking so that an eagle's nest type design is provided for personnel safety during adjustment and re-aiming of antennae procedures.

Because antenna positioning is now independent of the tower or pole's orientation, the configuration of the tower and the associated shelter for the radio frequency equipment can now be optimized because design criteria for the lower portion of the installation of the aerial tower is now disassociated from antenna positioning requirements atop the tower.

In that those skilled in the art will be familiar with aerial tower installations for wireless communication antennas, the beneficial effects described above and which apply generally to each of the exemplary descriptions and characterizations of the present invention will be appreciated. The specific structures through which these benefits are delivered will be described in detail herein below.

BRIEF DESCRIPTION OF THE DRAWINGS

In the following, the invention will be described in greater detail by way of examples and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed, movable or lockable relation one to the other.

Figure 1:
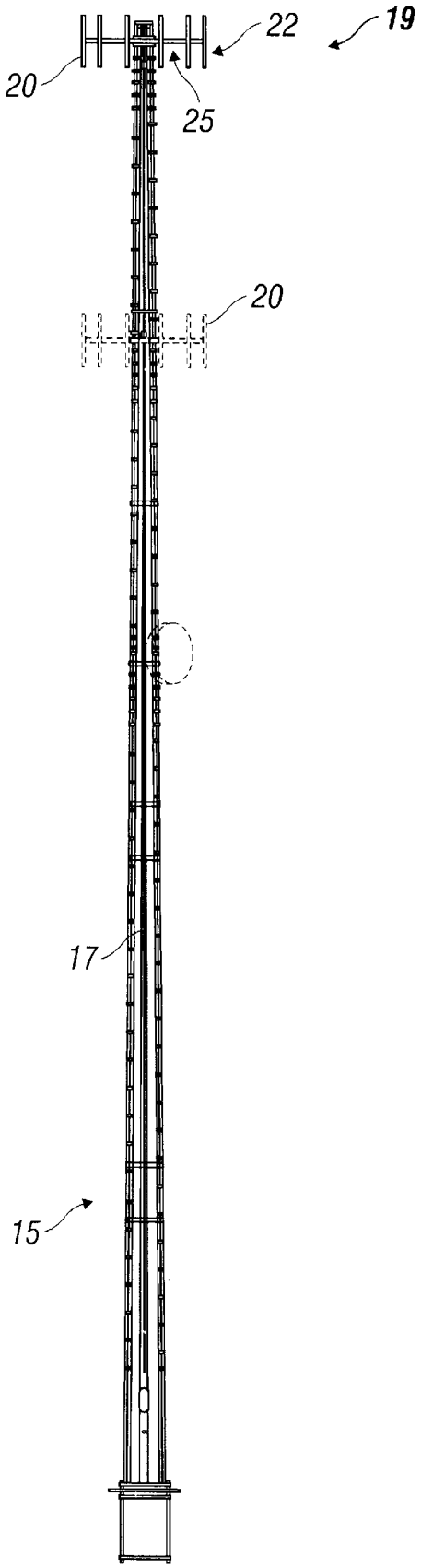
FIG. 1 is an elevational view of an erect monopole structure with a platform design according to the present invention mounted atop the tower and with a second support assembly or platform and dish style structure shown in phantom and located along the length of the tower.

Referring to FIG. 1, an aerial tower 15, also referred to as a monopole or simply a pole is shown which at a lower end is typically mounted upon a footing that is located adjacent to a shelter that contains radio frequency for RF equipment associated with wireless communication networks. The aerial tower 15 may be of any conventional design at least including hollow tubular steel columns 17 through which communication wiring is housed between a top end and lower end of the tower 15 and self supporting and guyed towers.

A personnel platform assembly 22 and associated antenna support assembly 25 are illustrated at the upper end of the tower 15. As described herein, the platform assembly 22 is utilized by personnel during installation and reconfiguration procedures for wireless communication transmitting and receiving devices 20 such as cellular antennas. The antenna support assembly 25 is utilized for interconnection to the several antennas 20 mounted thereupon.

Also illustrated in FIG. 1, but shown in phantom, is a second platform 22 and support 25 assembly located below the top installed assemblies. As will be described in greater detail herein below, interconnection may be made between adjacent support assemblies 25 or additional arrays of antennae 20 may be added at the supplemental support levels. As is also shown in FIG. 1, the support assemblies 25 may share pole space with other types of antennas such as the dish-shaped antennas shown in phantom midway up the pole 15.

Figure 3:
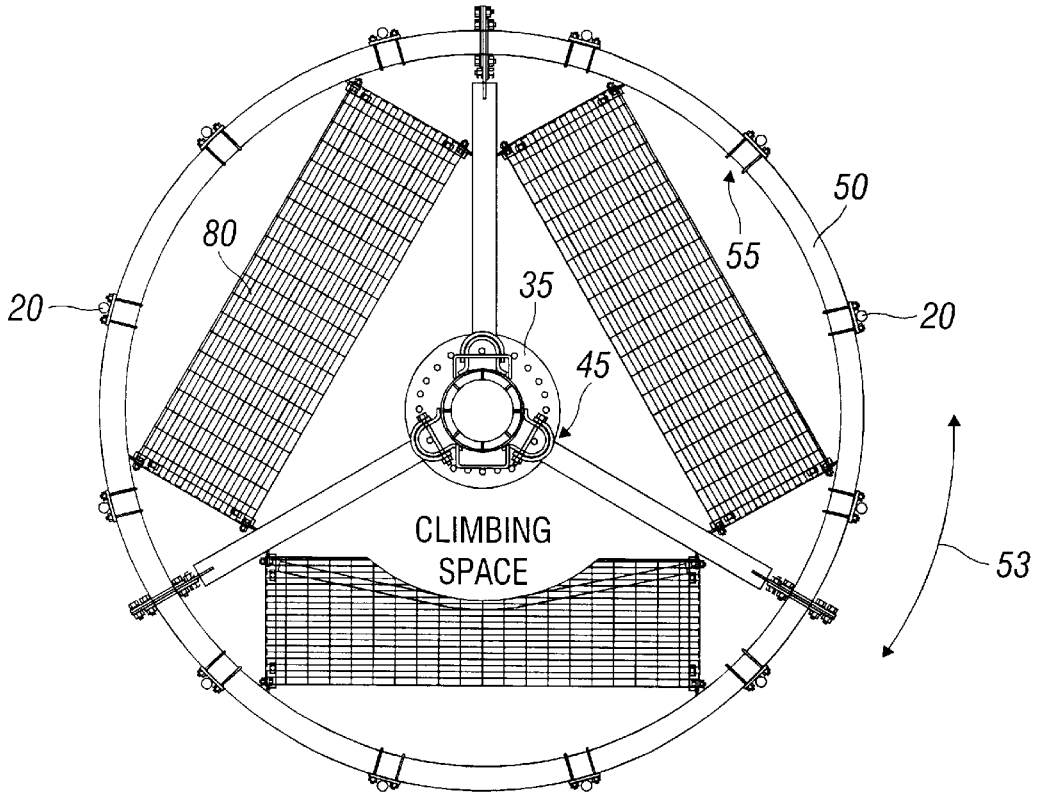
FIG. 3 is a top plan view of an alternative embodiment configured for mounting upon an existing or new pole using a connective flange.
Figure 4:
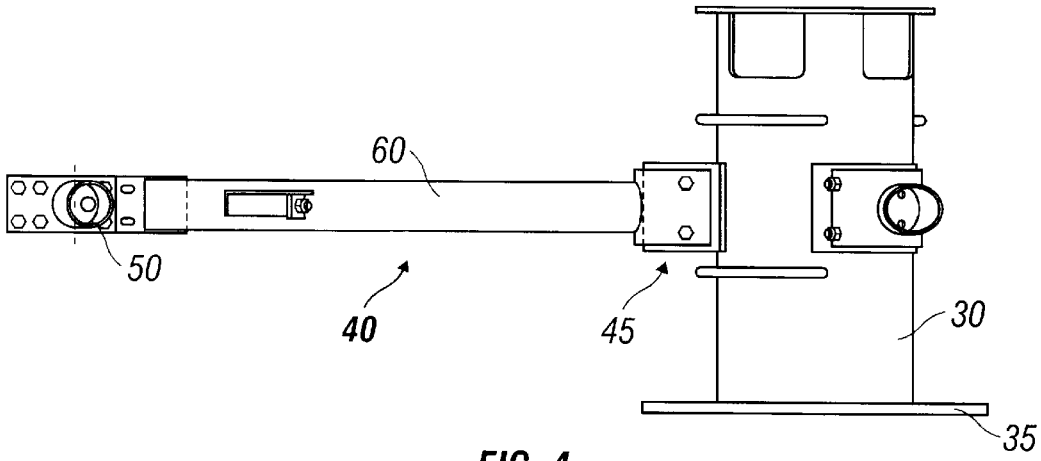
FIG. 4 is an elevational view in partial cutaway detailing the extension column, mounting flange and suspension arms of the platform and antenna support assemblies.
Figure 5:
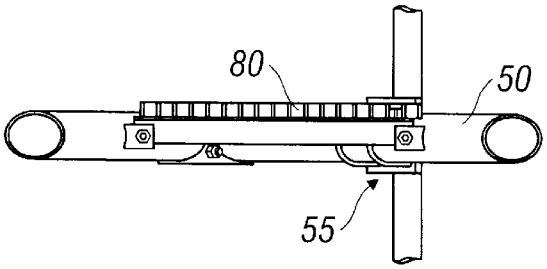
FIG. 5 is a partial cutaway elevational view illustrating the association between a floor deck panel and the guide rail.

As may be best appreciated through FIGS. 3 and 4, the platform and support assemblies 22,25 of one embodiment are advantageously configured for being positioned atop an aerial tower 15 upon a mounting flange 35 having an extension column 30 projecting upright therefrom. Through the use of such a mounting flange 35, this embodiment of the present invention may be utilized in new tower installations or as a retro-fit on existing towers having a top end terminating in a mating flange thereby facilitating mating engagement thereupon. Both the platform assembly 22 and the antenna support assembly 25 are carried upon a support frame 40. A connecting assembly 45 provides a superstructure upon which the personnel platform assembly 22 and an antenna support assembly 25 are suspended. The antenna support assembly 25 includes a guide rail 50 which substantially encircles the top end 19 of the tower 15. Suspension arms 60 are utilized which are coupled between the extension column 30 and the guide rail 50.

It should be appreciated that the encircling guide rail 50 may be constructed in a plurality of sections. Exemplarily, three sections are employed to create the circular guide rail 50 in FIG. 2. The connections at each end of the suspension arm 60 may be of variable design, but advantageously, the radial distal end of the arm 60 to which the guide rail 50 is attached is configured for separate connection to each of two adjacent guide rail 50 sections. In this manner, erection of the rail 50 in sections is facilitated. Still further, these adjacent connections further accommodate interconnection between the two rail sections. In this manner, the overall integrity of the circular guide rail 50 is fortified. This may be accomplished by simple bolt and flange connections wherein separate sets of bolt receiving apertures are provided for each of two converging rail sections.

At the opposite end of the support arm 60 is a connection to the extension column 30. This connection is also best appreciated in FIGS. 2, 3 and 4 where it is shown that complementary and substantially U-shaped connectors are matingly engaged and are secured by two spaced apart bolts. In this manner, the suspension arms 60 are rigidly and radially erected upon the column 30. The mating engagement across the U-shaped connector plates provides more surface-to-surface contact and greater security in the connection.

The personnel platform assembly 22 includes floor deck panels 80 which are exemplarily mounted by connections at both the support arms 60 and the guide rail 50. In this manner, the accommodation of personnel atop the aerial tower 15 and adjacent to antenna 20 mounted thereon is accommodated. In the specific embodiment illustrated in FIG. 3, one of the deck panels 80 is scalloped away from the extension column 30 so that a user may readily climb around the mounting flange 35 and be admitted upon the platform assembly 22. The deck panel 80 may be advantageously constructed from conventional grating that is slip resistant and of sufficient strength to safely support those persons who may be required to scale the aerial tower 15 up to and upon the platform assembly 22 for antenna 20 installation and reconfiguration procedures.

Figure 2:
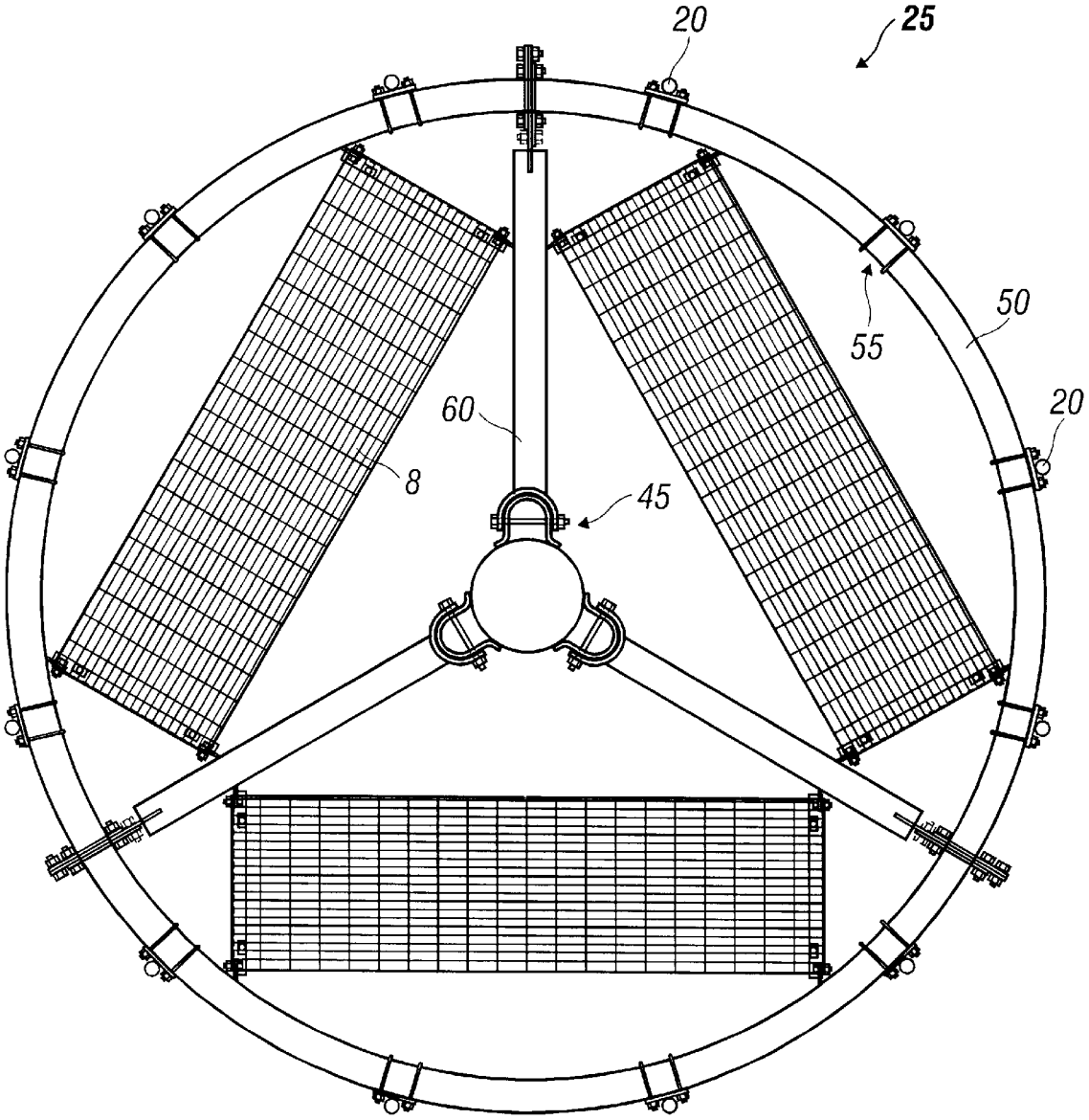
FIG. 2 is a top plan view of one embodiment of the platform and antenna support assembly according to the present invention.

A primary utility of the present invention is derived from the guide rails' 50 encircling design about the aerial tower 15 or the upper pedestal extension in the configuration illustrated in FIGS. 2 and 3. A circular configuration of the guide rail 50 is preferred and illustrated, but not required. The importance of the design is that it substantially surrounds the aerial tower 15, or an extension thereof, and facilitates mounting of an antenna 20 at any location along its length 53. Therefore, variations may be made in the specific configuration of the rail 50 without departing from the surrounding nature that facilitates continuously variable positioning capabilities for antenna 20.

The ability to continuously and variably position one or more antennas 20 upon the guide rail 50 is accommodated by the coupling 55 therebetween. This characteristic is derived from the coupling's 55 ability to be releasably fixed at any position upon the guide rail 50. In the preferred and illustrated embodiment, the coupling 55 is a pair of U-shaped bolts that complementarily mate with a portion of the round tubular guide rail's 50 construction. By tightening or loosening end bolts, the antenna 20 and/or the support upon which it may be carried is loosened or fixed in a locked manner upon the rail 50. When loosened, the U-bolt coupling 55 is permitted to slide to any location upon the continuous rail 50. In this manner, an antenna 20 may be positioned at any location along a rail's 50 length. Still further, by no longer having to disconnect and rotate the entire pedestal upon the mounting flange 35, all wiring connections may be maintained to the antenna during reconfiguration procedures and its operation remains continuous. As intimated herein above, this is a highly desirable feature in that not only are reconfiguration procedures significantly streamlined, but there is also no service down time associated with such procedures.

Figure 6:
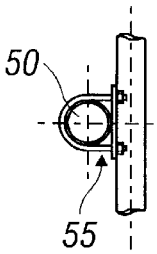
FIG. 6 is a partial cutaway view showing the friction connection in the form of an U-bolt coupling for an antenna support to the guide rail.
Figure 7:
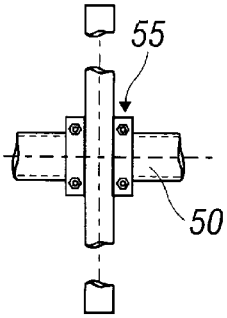
FIG. 7 is a backside elevational view of the friction connection illustrated.

It should be appreciated that a preferred embodiment provides for the utilization of round tubular in the construction of the guide rail 50, but is not required. Steel angle that is appropriately configured can be as advantageously utilized as can other shapes because the coupling 55 between the rail 50 and the antenna 20 can be similarly configured or releasable fixation along the rail's 50 length. An additional advantage of the round tubular construction of the rail 50 and the U-bolt coupling 55 is that rotation of the connection about a longitudinal axis of the guide rail 50 is accommodated. In this manner, tilting of the antenna 20 with respect to a horizontal axis is easily facilitated. This is important when a down-tilt is required of the antenna 20 and any associated support assembly so that a coverage area may be more focused. Essentially, any tilted orientation of an antenna 20 may be achieved provided neither the antenna itself or its supporting structure conflicts with other components of the platform 22 or support 25 assembly or the aerial tower 15 upon which it is supported. This particular connection is best appreciated in FIGS. 6 and 7 where this cooperation of components is shown.

Figure 9:
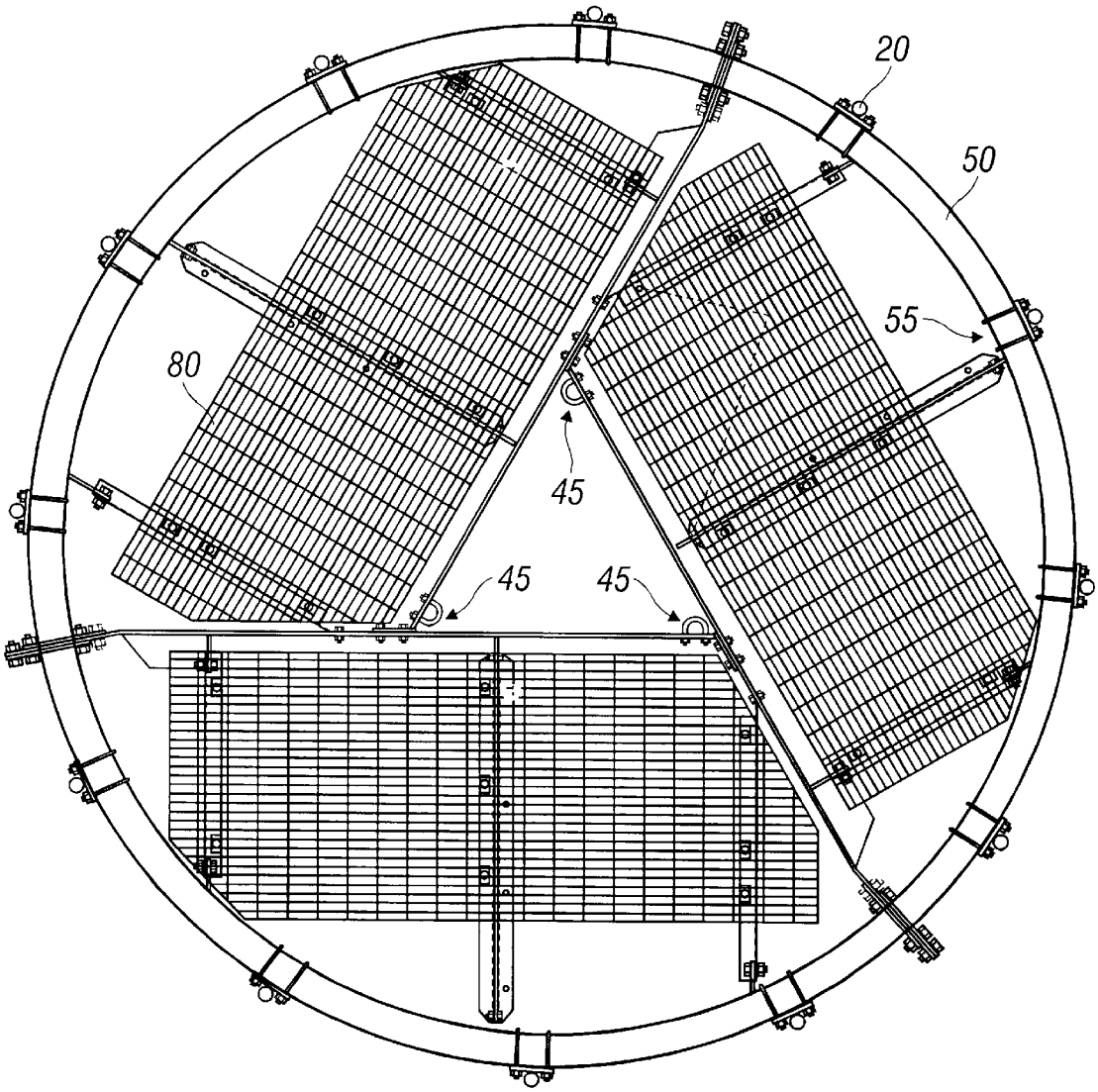
FIG. 9 is a top plan view of an alternative embodiment configured for mounting upon a guyed tower structure.

In the embodiment of FIG. 2, there is no need for a mounting flange 35 and extension column 30 to be included in the support assembly's construction. Instead, the suspension arms 60 and all which they support are connected directly to the support column 17, but in a similar manner as that described above regarding the various interconnections to the extension column 30 of the embodiment illustrated in FIG. 3. It should be noted, however, that the optional floor deck panels 80 need not be scalloped because there is no flange around which personnel must circumnavigate to gain access to the platform. In the guyed tower embodiment of FIG. 9, this same type of configuration is utilized, but the interconnection of the platform to the pole is altered to accommodate the guyed tower's construction.

In the illustrated embodiments, it may be considered that the antenna 20 is directly connected to the guide rail 50 through the utilization of the paired U-bolt coupling 55. In more typical designs, however, an intermediary support will be utilized that is commonly an extension pole to which connection of the antenna 20 is accomplished. Such an extension pole is often required because the size of the antenna 20 requires multiple connections in order for sufficient strength to be established across the connection for safe support of the antenna 20 both in view of its weight and wind drag loads encountered under design criteria loading. Other designs for the interconnection may be utilized and will still fall within the scope and spirit of the present invention.

Figure 8:
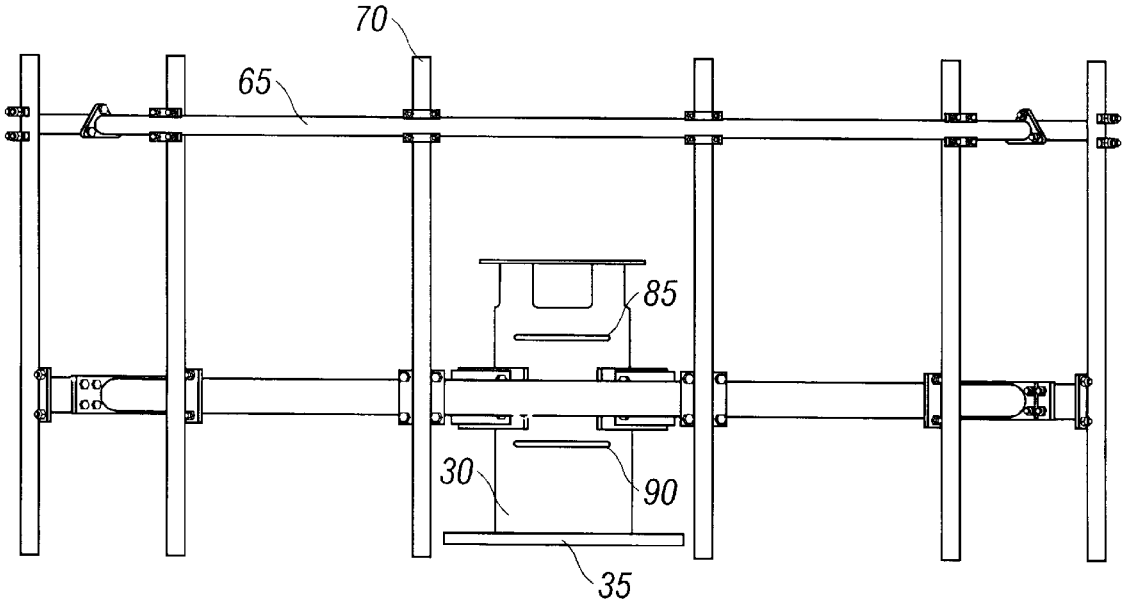
FIG. 8 is an elevational view of a hand rail assembly mounted to the guide rail of the antenna support assembly.

A similar type connection to the coupling 55 may be utilized to attach a plurality of upright posts 70 to the railing 50. These upright posts, in an upwardly projecting configuration, can support a hand railing 65 as illustrated in FIG. 8. In this manner, an eagle's nest type construction and enclosure is provided for personnel working therein. In addition to the security that such a hand railing 65 may provide, hand-hold 85 and belt-off connectors 90 are also provided at the platform level for enhanced safety to those personnel working thereon. Alternatively, such posts 70 may be interconnected between adjacent guide rails 50 mounted upon the aerial tower 15 for providing greater accommodation for equipment mounted thereupon. While interconnection of a supporting element between two or more guide rails 50 accommodates greater load because of increased locations for connection thereto, the continuously variable positioning about the tower is maintained because each connection to the a guide rail 50 has the characteristics described herein above so that sliding movement thereon is facilitated, as well as a clamping action once the desired position is attained.

In the illustrated embodiment, the guide rails 50, as well the suspension arms 60 are constructed from round tubular steel. The rounded construction of these elements advantageously reduces their resistance to wind and therefore lessens drag experienced thereupon. This enhancement complements the design of the tower 15 in that greater antenna 20 loads will be permitted for a specific tower design.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

INDUSTRIAL APPLICABILITY

The present invention finds applicability in the wireless communication industries, and more specifically in the design and construction of aerial towers used to elevate the remote transmitting and receiving devices more commonly referred to as antennas.

What is claimed and desired to be secured by Letters Patent is as follows:

1. A support assembly for wireless communication transmitting and receiving devices, said support assembly comprising:

a support frame connectable upon an aerial tower, said support frame adapted for supporting wireless communication transmitting and receiving devices thereupon;

a connecting assembly for fixing said support assembly at an above-ground elevation upon an aerial tower; and a guide rail suspended at a distance about said connecting assembly, said guide rail being substantially circular in shape and adapted for accepting a coupling to a wireless communication transmitting or receiving device, said coupling being substantially continuously positionable along a length of said guide rail for accommodating variable positioning of the wireless communication transmitting or receiving device about an aerial tower.

2. The invention as recited in claim 1, wherein said coupling is adapted to be releasably fixable upon said length of said guide rail.

3. The invention as recited in claim 1, wherein said guide rail substantially encircles said connecting assembly.

4. The invention as recited in claim 1, wherein said guide rail is constructed from tubular steel having a substantially circular cross-sectional shape.

5. The invention as recited in claim 1, said support assembly further comprising:

suspension arms connected between said connecting assembly and said guide rail for suspending said guide rail about said connecting assembly.

6. The invention as recited in claim 1, said support assembly further comprising:

a plurality of substantially upright posts connected upon said guide rail at a lower end of each of said upright posts and each of said plurality of upright posts being connected to a hand rail distally from said lower end.

7. The invention as recited in claim 1, said support assembly further comprising:

at least one floor deck panel establishing a platform for supporting personnel at said support assembly when said support assembly is suspended upon an aerial tower post.

8. The invention as recited in claim 1, wherein said coupling is adapted to be positionally adjustable about a substantially horizontal axis for accommodating down-tilt of a wireless communication transmitting or receiving device supported thereupon.

9. The invention as recited in claim 1, wherein said coupling is adapted for sliding movement along said guide rail thereby accommodating continuous operation of a wireless communication transmitting or receiving device during a repositioning procedure thereof.

10. The invention as recited in claim 1, said support assembly further comprising:

a mounting flange adapted to be connectable with a mating flange fixed upon an aerial tower for installing said support assembly upon the aerial tower.

11. The invention as recited in claim 1, said support assembly further comprising:

at least one hand-hold and at least one belt-off connector for releasable engagement by service personnel.

12. A support assembly for wireless telephone communication transmitting and receiving devices, said support assembly comprising:

a guide rail suspendable about an aerial tower, said guide rail being substantially circular in configuration and adapted to surround a substantial entirety of an aerial tower when suspended thereupon; and said guide rail being further adapted to accept a coupling to a wireless communication transmitting or receiving device along a substantial entirety of a length thereof for accommodating location of at least one wireless communication transmitting or receiving device at substantially any position about the aerial tower.

13. The invention as recited in claim 12, further comprising:

a coupling to a wireless communication transmitting or receiving device mounted upon said guide rail and adapted to be positionally adjustable about a substantially horizontal axis for accommodating down-tilt of a wireless communication transmitting or receiving device supported upon said coupling.

14. The invention as recited in claim 13, wherein said coupling is adapted for sliding movement along said guide rail thereby accommodating continuous operation of a wireless communication transmitting or receiving device during a repositioning procedure thereof.

15. The invention as recited in claim 12, wherein said guide rail is configured to be substantially horizontally oriented when suspended upon an aerial tower.

* * * * *